US009933200B2

(12) United States Patent
Qu et al.

(10) Patent No.: US 9,933,200 B2
(45) Date of Patent: Apr. 3, 2018

(54) DEFROST OPERATION MANAGEMENT

(71) Applicant: Lennox Industries Inc., Richardson, TX (US)

(72) Inventors: Yi Qu, Coppell, TX (US); Pete Hrejsa, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 793 days.

(21) Appl. No.: 14/091,887

(22) Filed: Nov. 27, 2013

(65) Prior Publication Data

US 2015/0143825 A1 May 28, 2015

(51) Int. Cl.

| | |
|---|---|
| ***F25B 41/00*** | (2006.01) |
| ***F25D 21/06*** | (2006.01) |
| ***F25B 47/00*** | (2006.01) |
| ***F25D 21/00*** | (2006.01) |
| ***F25B 30/02*** | (2006.01) |

(52) U.S. Cl.

CPC ..... *F25D 21/004* (2013.01); *F25B 30/02* (2013.01); *F25B 2313/0315* (2013.01); *F25B 2500/19* (2013.01); *F25B 2600/01* (2013.01); *F25B 2700/2106* (2013.01)

(58) Field of Classification Search

CPC ..... F25D 21/004; F25B 2313/0315; F25B 2500/19; F25B 30/02

USPC ..... 62/113, 153, 156, 278

See application file for complete search history.

(56) References Cited

U.S. PATENT DOCUMENTS

| | | | | |
|---|---|---|---|---|
| 3,950,962 | A * | 4/1976 | Odashima | F25B 13/00 62/156 |
| 4,327,557 | A * | 5/1982 | Clarke | F25D 21/006 62/153 |
| 4,338,790 | A * | 7/1982 | Saunders | F25D 21/006 62/156 |
| 4,346,755 | A * | 8/1982 | Alley | F24F 11/0009 165/231 |
| 4,790,144 | A * | 12/1988 | Yokouchi | F25B 49/02 62/156 |
| 4,882,908 | A * | 11/1989 | White | F25B 13/00 165/233 |
| 4,916,912 | A * | 4/1990 | Levine | F25B 47/025 62/155 |
| 5,156,010 | A * | 10/1992 | Inoue | F25D 21/006 165/240 |
| 5,775,116 | A * | 7/1998 | Matsumoto | F24F 11/0009 62/128 |
| 6,318,095 | B1 | 11/2001 | Guo et al. | |
| 2005/0150969 | A1* | 7/2005 | Nakayama | F24D 19/1039 237/12 |
| 2005/0257557 | A1* | 11/2005 | Chin | F25B 13/00 62/324.1 |
| 2007/0144187 | A1* | 6/2007 | Lee | F25B 47/025 62/155 |
| 2007/0180838 | A1 | 8/2007 | Shah | |
| 2008/0098761 | A1* | 5/2008 | Zangari | A47F 3/0408 62/249 |

(Continued)

*Primary Examiner* — Henry Crenshaw

(74) *Attorney, Agent, or Firm* — Baker Botts L.L.P.

(57) ABSTRACT

In various implementations, defrost operations may be managed. A change in the temperature of a heat exchanger may be determined. A determination whether to allow a defrost operation may be at least partially based on the determined change in the temperature of the heat exchanger.

20 Claims, 3 Drawing Sheets

(56) References Cited

U.S. PATENT DOCUMENTS

2012/0042667 A1* 2/2012 Fulmer ..... F25D 21/006
62/80

* cited by examiner

DEFROST OPERATION MANAGEMENT

TECHNICAL FIELD

The present disclosure relates to managing defrost operations in a heat pump.

BACKGROUND

Heat pumps may be utilized as part of an air conditioning system that provides heated air and cooled air to a location. During cold ambient temperatures, an outside heat exchanger and/or fan may be subject to icing. The icing may cause energy efficiency drops, reduce fan movement (e.g., including stopping), and/or mechanical failure (e.g., including pre-failure events such as wear on parts).

Defrost cycles may be utilized to reduce ice accumulation on surfaces and/or to inhibit ice formation. The defrost cycle may including reversing the flow of refrigerant such that hot refrigerant is provided to the outside heat exchanger and the temperature of the heat exchanger and/or fan is raised.

SUMMARY

In various implementations, a managing defrost operations may include determining change(s) in temperature of a heat exchanger of a heat pump. A determination may be made whether to allow at least one defrost operation of the heat pump at least partially based on at least one of the determined changes in temperature of the heat exchanger. Defrost operation(s) of the heat pump may be allowed, if a determination is made to allow at least one defrost operation.

Implementations may include one or more of the following features. Defrost operation(s) of the heat pump may be restricted, if a determination is made to not allow at least one defrost operation. In some implementations, one or more heat pump operating properties may be determined and determining whether to allow at least one defrost operation may be at least partially based on at least one of the determined heat pump operating properties. The heat pump properties may include ambient temperature, time between heat pump operations, and/or time elapsed. In some implementations, a time between heat pump operations may be determined. Determining whether to allow at least one defrost operation may include determining whether the determined time is less than a predetermined time. One or more defrost operations of the heat pump may be restricted, if the determined time is determined to be less than the predetermined time. In some implementations, a determination may be made whether the determined time is greater than a predetermined time. Defrost operation(s) may be allowed if the determined time is determined to be greater than the predetermined time and a determination is made to allow at least one defrost operation. In some implementations, an expected change in temperature of the heat exchanger may be determined at least partially based on an ambient temperature proximate the heat exchanger. Determining whether to allow at least one defrost operation may include allowing defrost operation(s) if a difference between at least one of the determined changes in temperature of the heat exchanger and the expected change in temperature of the heat exchanger is greater than approximately one degree Fahrenheit. In some implementations, determining whether to allow at least one defrost operation may include restricting defrost operation(s) if a difference between at least one of the determined changes in temperature of the heat exchanger and the expected change in temperature of the heat exchanger is less than approximately one degree Fahrenheit.

In various implementations, managing defrost operations may include determining change(s) in temperature of a heat exchanger of a heat pump and an ambient temperature proximate the heat exchanger. A determination may be made whether to allow at least one defrost operation of the heat pump at least partially based on at least one of the determined changes in temperature of the heat exchanger and the determined ambient temperature.

Implementations may include one or more of the following features. Determining whether to allow defrost operation(s) may include determining whether the determined ambient temperature is less than a predetermined ambient temperature, and whether the determined change(s) in temperature of the heat exchanger are greater than a predetermined change in temperature. Defrost operation(s) of the heat pump may be allowed if the determined ambient temperature is less than the predetermined ambient temperature and if the determined change(s) in temperature of the heat exchanger are greater than the predetermined change in temperature. In some implementations, an expected ambient temperature and a variance may be determined. The variance may be a difference between the expected ambient temperature and the determined ambient temperature. In some implementations, if the variance is greater than a predetermined variance, use of ambient temperature in a determination of whether to allow defrost operation(s) may be inhibited such that the determination of whether to allow one or more defrost operations is at least partially based on at least one of the determined changes in temperature of the heat exchanger. In some implementations, if the variance is less than a predetermined variance, use of ambient temperature in a determination of whether to allow one or more defrost operations may be allowed such that the determination of whether to allow defrost operation(s) is at least partially based on the determined change(s) in temperature of the heat exchanger and the ambient temperature (e.g., determined ambient temperature and/or expected ambient temperature). A change in ambient temperature may be determined based at least partially on the determined ambient temperature. Determining whether to allow defrost operation(s) may include comparing the determined change(s) in temperature of the heat exchanger and the change in ambient temperature, and allowing at least one defrost operation based on the comparison. In some implementations, a time between heat pump operations may be determined. Determining whether to allow defrost operation(s) may include comparing at least one of the determined changes in temperature of the heat exchanger and the change in ambient temperature. Defrost operation(s) may be allowed if the determined time is greater than a predetermined time, and change(s) in temperature of the heat exchanger is a predetermined amount greater than the determined change in ambient temperature. In some implementations, a time between heat pump operations may be determined and defrost operation(s) may be restricted if the determined time is less than a predetermined time.

In various implementations, a heat pump may include a heat exchanger, sensor(s), a memory, and a processor. The heat exchanger may be exposed to ice accumulation conditions. Sensors may monitor one or more changes in temperature of the heat exchanger. The memory may store change(s) in monitored temperature and a defrost operation module. The defrost operation module may determine one or more changes in temperature of the heat exchanger of the heat pump, and determine whether to allow defrost operation(s) of the heat pump at least partially based on the determined change(s) in temperature. The processor may be adapted to execute the defrost operation module.

Implementations may include one or more of the following. The defrost operation module may determine a time between defrost operations, and restrict defrost operation(s) if the determined time is less than a predetermined time. Sensor(s) may monitor ambient temperature proximate the heat exchanger. In some implementations, the defrost operation module may be adapted such that determining whether to allow at least one defrost operation is at least partially based on at least one of the determined changes in temperature of the heat exchanger or the monitored ambient temperature. Sensor(s) may monitor ambient temperature proximate the heat exchanger. In some implementations, the defrost operation module may be adapted such that determining whether to allow at least one defrost operation comprises allowing at least one defrost operation if a change in ambient temperature is greater than approximately 1.2 times one of the determined changes in temperature of the heat exchanger. Sensor(s) may monitor one or more heat pump operation properties. The defrost operation module may be adapted such that determining whether to allow at least one defrost operation is at least partially based on at least one of the determined changes in temperature of the heat exchanger and at least one of the monitored heat pump operation properties.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Heat pumps may be utilized in a variety of applications, such as air conditioning and refrigeration systems. During operation, some portions of the heat pump, such as fan(s), housing(s), and heat exchanger(s) may be subject to conditions that cause an ice event (e.g., ice and/or frost accumulation). Frost/ice accumulation may cause energy efficiency drops and/or inhibited operation of at least a portion of the heat pump (e.g., reduction in heat capacity provided by a heat exchanger and/or ice accumulation may restrict fan blade movement).

Figure 1:
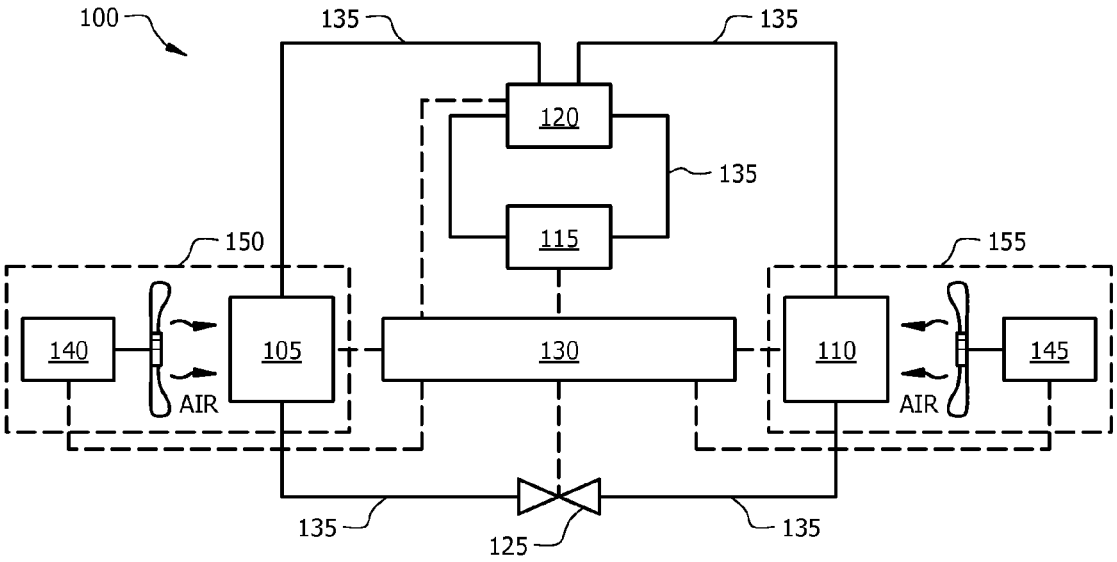
FIG. 1 illustrates an implementation of an example heat pump.

FIG. 1 illustrates an implementation of an example heat pump 100. As illustrated, the heat pump 100 includes one or more heat exchangers 105, 110. The heat exchangers may include a first heat exchanger 105 and a second heat exchanger 110. The first heat exchanger 105 and/or the second heat exchanger may be capable of operating as an evaporator and/or a condenser. The first heat exchanger may be exposed to ice accumulation conditioner (e.g., disposed in an environment in which ice may accumulate during operation, such as when disposed outside and/or positioned in an environment that may be cold, moist, and/or windy).

The heat pump may include a compressor 115. Any appropriate compressor 115 may be utilized.

The heat pump 100 may include valves. As illustrated, the heat pump may include a reversing valve 120 (e.g., a valve capable of changing the direction of flow) and/or an expansion valve 125.

A controller 130 (e.g., a computer) may be coupled (e.g., communicably, such as by wires or linked by Wi-Fi) to component(s) of the heat pump 100 and control various operations of the component(s) and/or system. For example, the controller 130 may include management modules, such as a defrost module to perform various operations of the heat pump 100. The management modules may control operations of the heat pump, such as receiving requests for operation, determining whether to respond to requests for operation, responding to requests for operation, and/or operating various components (e.g., compressors, reversing valves, and/or expansion valves). The defrost module may perform various operations to reduce and/or inhibit the accumulation of frost on portions of the heat pump. For example, primary defrost module may determine properties and/or changes in properties of the heat pump (e.g., heat exchanger temperatures, ambient temperatures, ambient humidity, operation times, time between operations, and/or other properties), determine whether to allow defrost operations, determine what properties to utilized in determining whether to allow a defrost operation, determine what type of defrost operations to allow, transmit a signal to allow a defrost operation, restrict a defrost operation, allow a heat pump to respond to user requests, resume operation(s) of a heat pump, suspend operation(s) of a heat pump, etc.

Lines 135 (e.g., tubing) may couple various components and allow refrigerant to flow in and/or out of various components of the heat pump 100. Fans 140, 145 may cause air to flow through heat exchangers 105, 110 disposed proximate the fans. One or more of the fans may be disposed in a housing with a heat exchanger. For example, a fan 140 may be disposed in a housing with the first heat exchanger 105.

In some implementations, a portion of the heat pump 100 may be disposed outside a building (e.g., an "outdoor portion" on the ground proximate a building and/or on a roof of the building) and a portion of the heat pump may be disposed inside the building (e.g., an "indoor portion"). For example, an outdoor portion 150 may include heat exchanger 105 and fan 140 and an indoor portion 155 may include heat exchanger 110 and fan 145. The outdoor portion 150 and/or the indoor portion 155 may be at least partially disposed in housing(s).

A heat pump 100 may allow operations with heating and cooling cycles. During a cooling cycle, cool air may be provided by blowing air (e.g., from a fan 145) at least partially through a second heat exchanger 110 (e.g., in the indoor portion). The second heat exchanger may act as an evaporator to evaporate liquid refrigerant in the second heat exchanger. Heat may be removed from the air provided by the fan 145 and transferred at least partially to the liquid refrigerant to evaporate the refrigerant. Thus, a temperature of the air may be reduced and the cool air may be provided to a location (e.g., via ducting). The gaseous refrigerant may exit the second heat exchanger 110, be compressed by a compressor 115, and delivered to a first heat exchanger 105 (e.g., outdoor portion), which acts as a condenser. The second heat exchanger 105 may condense the gaseous refrigerant, for example, by blowing air (e.g., from a fan 140) at least partially through the second heat exchanger 105 to remove heat from the gaseous refrigerant.

To operate the heat pump 100 in a heating cycle, the heat pump 100 may include a reversing valve 120 to change the direction of refrigerant flow through the heat pump such that the refrigerant flows in the opposite direction as the direction in which the refrigerant flows in the cooling cycle. For example, hot air may be provided by blowing air (e.g., using a fan 140) across the second heat exchanger 110 (e.g., indoor portion). The second heat exchanger 110 may act as a condenser and condense gaseous refrigerant in the second heat exchanger 110. Heat from the condensation may be transferred from the refrigerant to the air provided by the fan 145. Thus, the temperature of the air may be elevated and heated air may be provided (e.g., via ducting) to a location. The condensed refrigerant may be provided to the first heat exchanger 105. The second heat exchanger 105 (e.g., in the outdoor portion) may act as an evaporator. Air from the fan 140 may be provided to the first heat exchanger (e.g., at least a portion of the first heat exchanger may at least partially surround the fan) and may remove heat from the refrigerant in the first heat exchanger 105. As heat is removed from the refrigerant, the refrigerant may be evaporated. The temperature of the air, provided by fan 140, may be cooler leaving the second heat exchanger 105 than when entering the second heat exchanger 105.

During use, when a heat pump 100 is exposed to cold and moist air, frost (e.g., frost and/or ice) may accumulate on surfaces and/or other portions of component(s) of the heat pump 100. For example, when the first heat exchanger 105 and/or fan 140 are subject to moist and/or cold air, frost may accumulate on surfaces of the fan housing, fan blade, fan orifice, heat exchanger housing, and/or heat exchanger coil (e.g., coil tubing and/or fins). The frost accumulation may cause inhibit operation of at least a portion of the heat pump (e.g., reduced heat capacity provided by a heat exchanger and/or the fan blade may be inhibited from rotating due to ice accumulation between the fan blade and the fan orifice) and/or may cause energy efficiency drops. Thus, one or more defrost operations of the heat pump may be allowed to reduce and/or inhibit ice accumulation on portions of the heat exchanger and/or fan.

Figure 2:
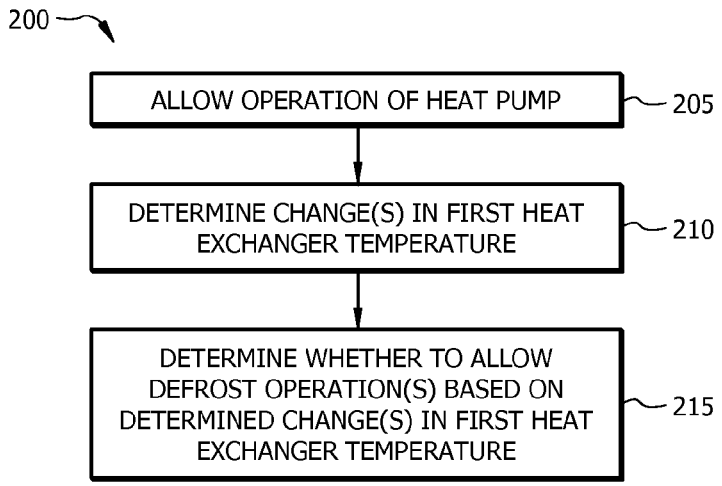
FIG. 2 illustrates an implementation of an example process for managing defrost operations.

FIG. 2 illustrates an implementation of an example process 200 for determining whether to allow a defrost operation. Operation of a heat pump may be allowed (operation 205). For example, a request may be provided (e.g., by a user using a thermostat) to provide heat to a location. The request may be received by the controller and the heat pump may be allowed to operate based on the received request.

Change(s) in temperature of a first heat exchanger of a heat pump may be determined (operation 210). The heat pump may include sensor(s) proximate the first heat exchanger. The sensor(s) may be adapted to measure properties of the heat pump. For example, the sensor may monitor properties, such as temperature (e.g., coil temperature), change in temperature, etc. The controller (e.g., a defrost operation module) may determine the change in temperature of the first heat exchanger. For example, the controller may determine a first temperature and a second temperature of the first heat exchanger and determine the difference between the first temperature and the second temperature. The first temperature may be a previous reading, in some implementations.

A determination may be made whether to allow defrost operation(s) based on the determined change(s) in first heat exchanger temperature (operation 215). A defrost operation may be allowed to reduce and/or inhibit ice accumulation on portions of the heat pump (e.g., fan(s), housing(s), and/or heat exchanger(s)). The change in first heat exchanger temperature may be correlated with a probability of ice accumulation proximate the first heat exchanger, and thus be utilized to determine whether to allow a defrost operation. For example, a change in a first heat exchanger temperature may be within a predetermined range of values in some implementations. When ice accumulates on surfaces of the heat pump (e.g., the first heat exchanger), the temperature may rapidly decrease due to the accumulated ice. Thus, when the change in the first heat exchanger temperature is greater than the range of values, a defrost operation may be allowed.

Process 200 may be implemented by various systems, such as system 100. In addition, various operations may be added, deleted, and/or modified. For example, defrost operation(s) may be allowed when a determination is made to allow defrost operations. Defrost operation(s) may be restricted when a determination is made to not allow defrost operations.

Figure 3:
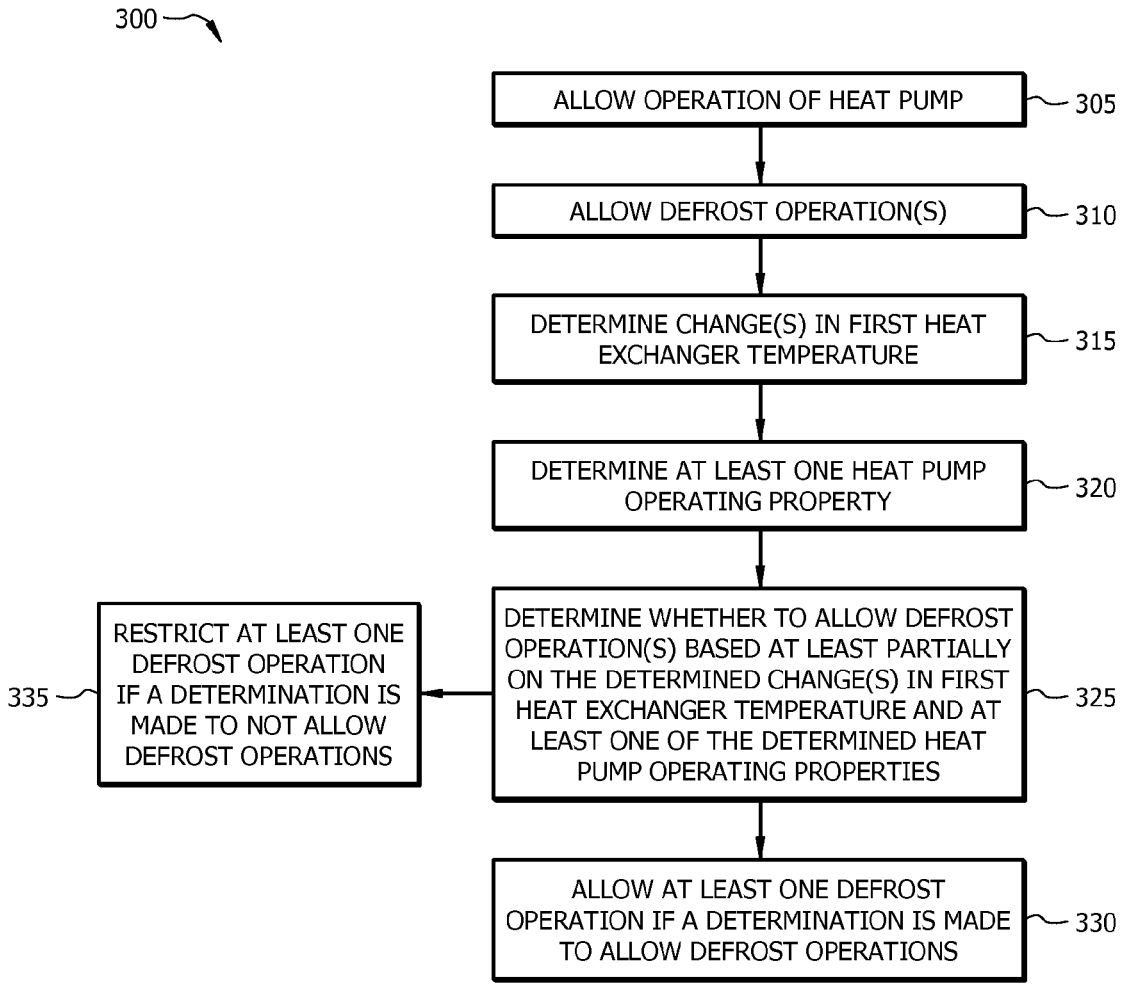
FIG. 3 illustrates an implementation of an example process for managing defrost operations.

FIG. 3 illustrates an implementation of an example process 300 for determining whether to allow a defrost operation. Operation of a heat pump may be allowed (operation 305). For example, a heating operation of a heat pump may be allowed. For example, a controller may receive a request from a user to a provide heated air to a location (e.g., a temperature controlled room, and/or a humidity controlled room). The controller may transmit a signal to the reversing valve of the heat pump such that refrigerant flows in a first direction through the heat pump. The first heat exchanger may be allowed to operate as a condenser and the second heat exchanger may be allowed to operate as an evaporator.

Defrost operation(s) may be allowed (operation 310). A defrost operation may include providing heat to and/or proximate to the first heat exchanger. For example, the controller may transmit a signal to the reversing valve to change the direction of refrigerant flow through the heat pump. In some implementations, a controller may transmit a signal to a heating element that generates heat to be provided to the first heat exchanger (e.g., the coil of the heat exchanger).

Change(s) in temperature of a first heat exchanger of a heat pump may be determined (operation 315). For example, a temperature of the first heat exchanger may be monitored and changes in the temperature may be determined. The changes in temperature and/or monitored temperature may be saved in a memory of the heat pump.

At least one heat pump operating property may be determined (operation 320). For example, the heat pump may include one or more sensors. The measurements from the sensors may be utilized to determined heat pump properties, such as heat pump operating properties (e.g., time between operations, ambient temperature, and/or ambient humidity). The determined heat pump operating properties may be saved in a memory of the heat pump.

A determination may be made whether to allow defrost operation(s) based at least partially on the determined change(s) in first heat exchanger temperature and at least one of the determined heat pump operating properties (operation 325). For example, the determined heat pump operating property may include an ambient temperature (e.g., proximate the first heat exchanger). Determining whether to allow defrost operation may include comparing the determined ambient temperature to a predetermined ambient temperature. A defrost operation may be allowed if the change in temperature of the first heat exchanger is greater than a predetermined change in temperature and if the determined ambient temperature is less than a predetermined ambient temperature. In some implementations, a defrost operation may be restricted if the change in temperature of the first heat exchanger is greater than a predetermined change in temperature and if the determined ambient temperature is greater than a predetermined ambient temperature. A defrost operation may be restricted if the change in temperature of the first heat exchanger is less than a predetermined change in temperature and if the determined ambient temperature is less than a predetermined ambient temperature. A defrost operation may be restricted if the change in temperature of the first heat exchanger is less than a predetermined change in temperature and if the determined ambient temperature is greater than a predetermined ambient temperature.

At least one defrost operation may be allowed if a determination is made to allow defrost operations (operation 330). For example, a heat pump may include heat pump operations such as one or more defrost operations. For example, a defrost operation may include allowing a cooling cycle. During the cooling cycle heat may be provided to the first heat exchanger since the first heat exchanger is operating as a condenser. Allowing the defrost operation may reduce the ice accumulation and/or inhibit ice accumulation on the heat pump or portions thereof (e.g., first heat exchanger, housing, and/or fan). For example, heat from a first heat exchanger operating as a condenser (e.g., when allowing a cooling cycle as a defrost operation) may reduce and/or inhibit ice accumulation by melting ice on surfaces of the heat pump proximate the first heat exchanger (e.g., coil, fan, and/or housing) and/or by raising the temperature of portions of the heat pump (e.g., coil, fan, and/or housing).

At least one defrost operation may be restricted if a determination is made to not allow defrost operations (operation 335). For example, a controller may transmit a signal to one or more portions of the heat pump to restrict a defrost operation. Restricting a defrost operation may increase user satisfaction. For example, when a defrost operation includes allowing a cooling operation, cool air may be provided to a location and user satisfaction may be decreased. Thus, by restricting a defrost operation from occurring too frequently, user satisfaction may be increased. In some implementations, by monitoring a change in first heat exchanger temperatures excess defrost operations (e.g., when a probability of ice accumulation is not high) may be restricted and thus, user satisfaction may be increased.

Process 300 may be implemented by various systems, such as system 100. In addition, various operations may be added, deleted, and/or modified. In some implementations, process 300 may be performed in combination with other processes such as process 200. For example, changes in first heat exchanger temperatures may be determined prior to allowing a defrost operation. In some implementations, allowing a defrost operation may include transmitting a signal to a reversing valve of a heat pump to allow reverse the flow of refrigerant through the system (e.g., to allow a cooling operation).

Figure 4:
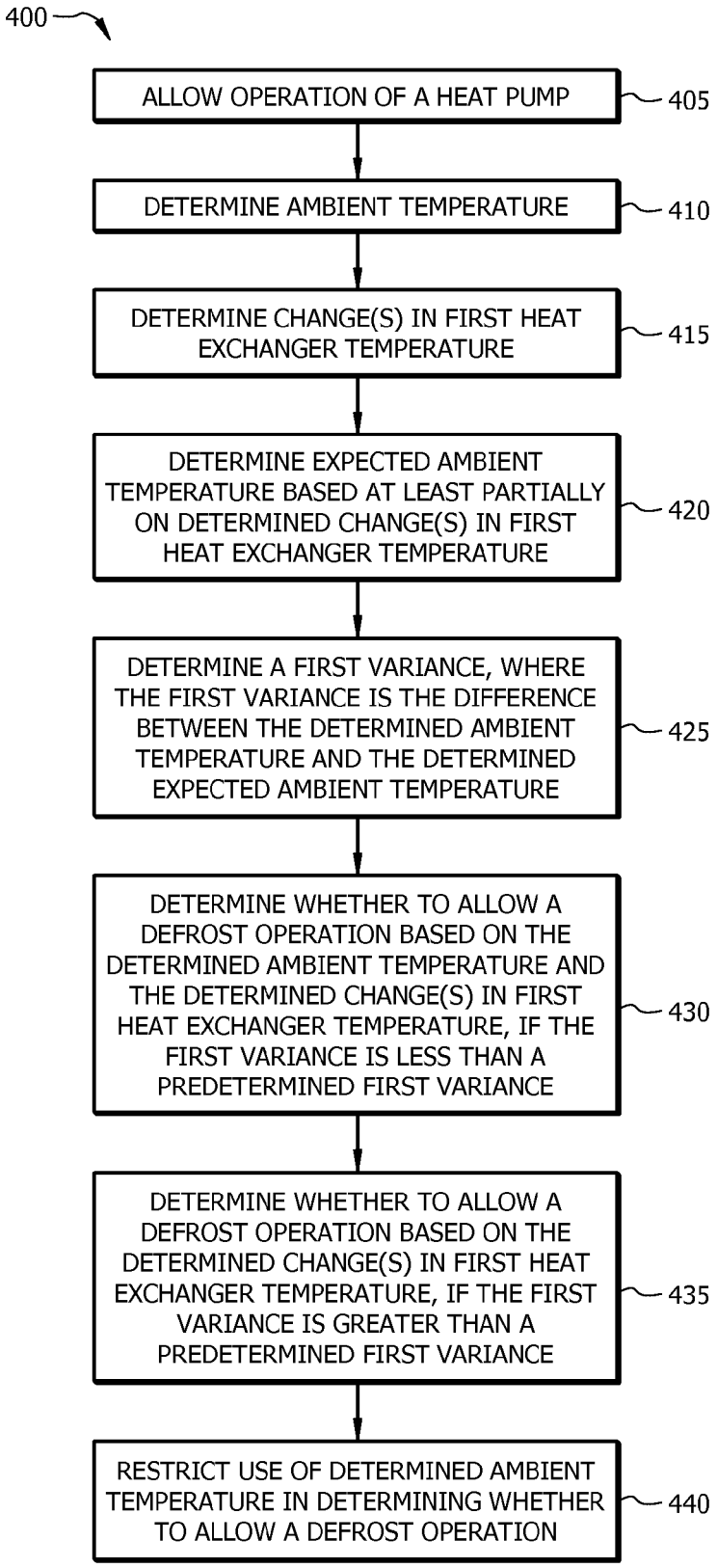
FIG. 4 illustrates an implementation of an example process for managing defrost operations.

FIG. 4 illustrates an implementation of an example process 400 for determining whether to allow a defrost operation. Operation of a heat pump may be allowed (operation 405). For example, a heating operation of a heat pump may be allowed. The heating operation may provide heated air to a location. During the heating operation, the first heat exchanger may operate as a condenser and thus, heat may be removed from the refrigerant and transferred to the air, portions of the first heat exchanger and/or surrounding portions of the first heat exchanger. Thus, the temperature of the air passing through the first heat exchanger may be reduced.

Ambient temperature may be determined (operation 410). For example, a sensor may be disposed proximate the first heat exchanger. The ambient temperature and/or changes in the ambient temperature of the air may be determined. The determined ambient temperature and/or changes in ambient temperature may be stored in a memory of the heat pump.

Change(s) in temperature of the first heat exchanger of the heat pump may be determined (operation 415). For example, sensor(s) may be coupled to the first heat exchanger such that changes in temperature of the first heat exchanger may be monitored and/or determined. The determined change(s) in temperature may be stored in a memory of the heat pump.

An expected ambient temperature may be determined at least partially based on the determined change(s) in the temperature of the first heat exchanger (operation 420). For example, an expected ambient temperature may be determined based on an algorithm stored in the memory of the heat pump. The expected ambient temperature may be approximately 1 to approximately 1.5 times the temperature of the first heat exchanger. For example, the expected ambient temperature may be approximately 1.2 times the temperature of the first heat exchanger. In some implementations, the expected ambient temperature may be approximately 1 to approximately 1.5 times the temperature of the first heat exchanger. An expected change in ambient temperature may be approximately 1.2 times the change in temperature of the first heat exchanger.

A first variance may be determined (operation 425). The first variance may be the difference between the determined ambient temperature and the determined expected ambient temperature. For example, the absolute value of the difference between the determined ambient temperature and the expected ambient temperature may be the first variance.

A determination may be made whether to allow a defrost operation at least partially based on the determined ambient temperature and the determined change(s) in temperature of the first heat exchanger, if the first variance is less than a predetermined first variance (operation 430). For example, if the first variance is less than a predetermined first variance (e.g., 1 degree Fahrenheit and/or 5 degrees Fahrenheit), the ambient temperature may be utilized in determining whether to allow a defrost operation. In some implementations, the defrost operation may be restricted when the ambient temperature is greater than a predetermined low ambient temperature (e.g., 35 degrees Fahrenheit). The defrost operation may be allowed if the ambient temperature is less than or approximately equal to the predetermined low ambient temperature and the determined change in temperature of the first heat exchanger satisfies a high temperature change criteria. For example, the high temperature change criteria may be stored in a memory of the heat pump and retrieved by the controller of the heat pump. The high temperature change criteria may include criteria such as a change in first heat pump temperature is greater than 1 degree Fahrenheit and/or a change in first heat pump temperature is greater than 5 degrees Fahrenheit.

A determination may be made whether to allow a defrost operation based at least partially on the determined change(s) in temperature of the first heat exchanger, if the first variance is greater than a predetermined first variance (operation 435). For example, if the first variance is greater than a predetermined first variance, then the determined ambient temperature may be unreliable (e.g., the sun may be shining on the sensor to elevate the sensor measurement, the sensor may be located in a shady spot to decrease the sensor measurement, and/or the sensor is malfunctioning). When the ambient temperature is determined to be unreliable (e.g., when the first variance is greater than the predetermined first variance), then use of the determined ambient temperature in determining whether to allow a defrost operation may be restricted (operation 440). For example, the determination may be made without utilizing the ambient temperature (e.g., a defrost operation may be allowed when a change in coil temperature exceeds a predetermined high temperature change value, such as 1 degree Fahrenheit).

Process 400 may be implemented by various systems, such as system 100. In addition, various operations may be added, deleted, and/or modified. In some implementations, process 400 may be performed in combination with other processes such as process 200 and/or process 300. For example, in some implementations, when use of the ambient temperature in determining whether to allow a defrost operation is restricted, an expected ambient temperature may be utilized. When the expected ambient temperature is above the predetermined low temperature value, the defrost operation may be restricted. When the expected ambient temperature is less than or approximately equal to the predetermined low temperature value, then the defrost operation may be allowed when the change in coil temperature exceeds a predetermined high temperature change value (e.g., 1 degree Fahrenheit and/or 5 degrees Fahrenheit). A determination may be made whether to allow a defrost operation at least partially based on the expected ambient temperature and the determined change(s) in temperature of the first heat exchanger, if the first variance is less than a predetermined first variance, in some implementations.

In some implementations, a change in ambient temperature may be determined. The change in ambient temperature may be compared to the change in temperature of the first heat pump. A determination of whether to allow a defrost operation of the heat pump based on the comparison. When the change in temperature of the first heat exchanger is greater than the sum of a first predetermined constant (e.g., from approximately 2 to approximately 2.5) and a second predetermined constant (e.g., from approximately 8.4 to approximately 8.8) times the change in ambient temperature, a defrost operation may be allowed. For example, when the change in temperature of the first heat exchanger is greater than 2.3+0.86 times the change in ambient temperature, then a defrost operation may be allowed. When the change in temperature of the first heat exchanger is less than or approximately equal to the sum of a first predetermined constant (e.g., from approximately 2 to approximately 2.5) and a second predetermined constant (e.g., from approximately 8.4 to approximately 8.8) times the change in ambient temperature, a defrost operation may be restricted. For example, when the change in temperature of the first heat exchanger is less than or approximately equal to 2.3+0.86 times the change in ambient temperature, then a defrost operation may be restricted.

In some implementations, one or more heat pump operating properties (e.g., time between heat pump operations) may be determined. The determined heat pump properties may be utilized in determining whether to allow a defrost operation. In some implementations, when a defrost operation is determined to be allowed based on the ambient temperature and/or change in first heat exchanger temperature, the defrost operation may be restricted and/or allowed based on the determined heat pump operating properties. For example, when a time between heat pump operations (e.g., time between defrost operations, time between heat operations, and/or other appropriate times) is less than a predetermined heat pump operation time, then the defrost operation may be restricted. When a time between heat pump operations is greater than or approximately equal to the predetermined heat pump operation time, the defrost operation may be allowed.

Although a specific implementation of a heat pump has been illustrated in FIG. 1, the heat pump may include any appropriate heat pump. For example, the heat pump may include more than one compressor, such as a tandem compressor. The heat pump may include an expansion valve, such as a thermal expansion valve.

Although a specific controller has been described in FIG. 1, the controller may be any appropriate computer or other programmable logic device. The controller may include a processor that executes instructions and manipulates data to perform operations of the controller. The instructions may be stored on a memory of the heat pump and may include one or more of the described operations, such as the operations described in processes 200, 300, and/or 400. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include data, such as predetermined property values (e.g., temperatures, times, and/or pressure); predetermined criteria (e.g., high temperature criteria), and/or predetermined low ambient temperatures; predetermine low times between operations; predetermined high times between operations; predetermined criteria to facilitate determination of whether to allow specific operations; adjustments and/or criteria related to when to allow adjustments to predetermined times and/or temperatures, periods of time that operations should run (e.g., maximum operational time); and/or any other data useful to the operation of the air conditioner.

In addition, various software may be stored on the memory. For example, instructions (e.g., operating systems and/or other types of software), a management module, and/or defrost operation module may be stored on the memory. The defrost operation module may include instructions to perform one or more of the operations described in processes 200, 300, and/or 400, such as operating the air conditioner during normal operations (e.g., operations in which the system operates based at least partially on user requests for operation) and/or determining whether to allow a defrost operation. For example, the management operation module may receive requests for operation from a user and operate the air conditioner to satisfy the user request. The defrost operation module may determine properties and/or changes in properties of a heat pump; determine whether to use the determined property in a determination of whether to allow a defrost operation; determine whether to allow a defrost operation, etc. The defrost operation module may determine which defrost operation to allow from a set of predetermined defrost operations. The defrost operation module may allow and/or restrict defrost operations, as appropriate.

In some implementations, modules may be combined, such as into a single module or multiple modules. Management modules and/or defrost operation management modules may be distinct modules. In an implementation, management modules and/or defrost operation modules may include various modules and/or sub-modules.

A communication interface may allow the controller to communicate with components of the heat pump, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the heat pump stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although FIG. 1 provides one example of controller that may be used with the disclosure, controller can be implemented through computers such as servers, as well as a server pool. For example, controller may include a general-purpose personal computer (PC) a Macintosh, a workstation, a UNIX-based computer, a server computer, or any other suitable device. In some implementations, a controller may include a programmable logic device. For example, the controller may be mounted to a wall of a location in which air conditioning may be provided. According to one implementation, controller may include a web server. Controller may be adapted to execute any operating system including UNIX, Linux, Windows, or any other suitable operating system. Controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although mechanical failure and mechanical failure events have been described as conditions that cause mechanical failure, conditions that precede mechanical failure may also be included, such as excessive wear on parts.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a defrost operation" includes a combination of two or more defrost operations and reference to "a heat exchanger" includes different types and/or combinations of heat exchangers.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method of managing defrost operations, the method comprising:

determining one or more changes in temperature of a heat exchanger of a heat pump;

determining a time between heat pump operations;

determining an ambient temperature proximate the heat exchanger;

determining an expected ambient temperature based at least partially on the one or more changes in temperature of the heat exchanger;

determining a variance, wherein the variance is the difference between the expected ambient temperature and the determined ambient temperature;

determining whether to allow at least one defrost operation of the heat pump at least partially based on the one or more changes in temperature and the determined ambient temperature if the variance is less than a predetermined variance;

determining that the determined ambient temperature is unreliable and determining whether to allow at least one defrost operation of the heat pump at least partially based on the one or more changes in temperature and the expected ambient temperature if the variance is greater than the predetermined variance;

restricting one or more defrost operations if the determined time is less than a predetermined time; and allowing at least one of the defrost operations of the heat pump if a determination is made to allow at least one defrost operation and if the determined time is greater than or equal to the predetermined time.

2. The method of claim 1, further comprising:

restricting one or more defrost operations of the heat pump, if a determination is made to not allow at least one defrost operation.

3. The method of claim 1, further comprising:

determining one or more heat pump operating properties; wherein determining whether to allow at least one defrost operation is further based at least partially on at least one of the determined heat pump operating properties.

4. The method of claim 3, wherein at least one of the heat pump properties comprises ambient temperature, time between heat pump operations, or time elapsed.

5. The method of claim 1, further comprising:

determining an ambient temperature;

determining an expected ambient temperature;

determining a variance between the determined ambient temperature and the expected ambient temperature;

wherein determining whether to allow at least one defrost operation of the heat pump is at least partially based on the determined ambient temperature, and wherein if the variance is greater than a predetermined variance then the expected ambient temperature is used in place of the determined ambient temperature.

6. The method of claim 5, wherein determining whether to allow at least one defrost operation of the heat pump comprises allowing at least one defrost operation if the determined ambient temperature is lower than a predetermined temperature and if the at least one change in temperature is greater than a predetermined change.

7. The method of claim 1, further comprising:

determining an expected change in temperature of the heat exchanger based at least partially on an ambient temperature proximate the heat exchanger;

wherein determining whether to allow at least one defrost operation comprises allowing one or more defrost operations if a difference between at least one of the determined changes in temperature of the heat exchanger and the expected change in temperature of the heat exchanger is greater than approximately one degree Fahrenheit.

8. The method of claim 1, further comprising:

determining an expected change in temperature of the heat exchanger based at least partially on an ambient temperature proximate the heat exchanger;

wherein determining whether to allow at least one defrost operation comprises restricting one or more defrost operations if a difference between at least one of the determined changes in temperature of the heat exchanger and the expected change in temperature of the heat exchanger is less than approximately one degree Fahrenheit.

9. A method of managing defrost operations, the method comprising:

determining one or more changes in temperature of a heat exchanger of a heat pump;

determining an ambient temperature proximate the heat exchanger;

determining a time between heat pump operations;

determining an expected ambient temperature based at least partially on the one or more changes in temperature of the heat exchanger;

determining a variance, wherein the variance is the difference between the expected ambient temperature and the determined ambient temperature;

determining whether to allow at least one defrost operation of the heat pump at least partially based on the one or more changes in temperature and the determined ambient temperature if the variance is less than a predetermined variance; and determining that the determined ambient temperature is unreliable and determining whether to allow at least one defrost operation of the heat pump at least partially based on the one or more changes in temperature and the expected ambient temperature if the variance is greater than the predetermined variance.

10. The method of claim 9, wherein determining whether to allow at least one defrost operation comprises:

determining whether the determined ambient temperature is less than a predetermined ambient temperature; and determining whether at least one of the determined changes in temperature of the heat exchanger is greater than a predetermined change in temperature; and further comprising:

allowing one or more defrost operations of the heat pump if the determined ambient temperature is less than the predetermined ambient temperature and if at least one of the determined changes in temperature of the heat exchanger is greater than the predetermined change in temperature.

11. The method of claim 9, further comprising:

determining an expected ambient temperature; determining a variance, wherein the variance comprises a difference between the expected ambient temperature and the determined ambient temperature; and inhibiting use of ambient temperature in a determination of whether to allow one or more defrost operations such that the determination of whether to allow one or more defrost operations is at least partially based on at least one of the determined changes in temperature of the heat exchanger, if the variance is greater than a predetermined variance.

12. The method of claim 9, further comprising: determining an expected ambient temperature; determining a variance, wherein the variance comprises a difference between the expected ambient temperature and the determined ambient temperature; and allowing use of ambient temperature in a determination of whether to allow one or more defrost operations such that the determination of whether to allow one or more defrost operations is at least partially based on at least one of the determined changes in temperature of the heat exchanger and the ambient temperature, if the variance is less than a predetermined variance.

13. The method of claim 9, further comprising: determining a change in ambient temperature based at least partially on the determined ambient temperature; and wherein determining whether to allow one or more defrost operations comprises: comparing at least one of the determined changes in temperature of the heat exchanger and the change in ambient temperature; and allowing at least one defrost operation based on the comparison.

14. The method of claim 9 further comprising: determining a change in ambient temperature based at least partially on the determined ambient temperature; and determining a time between heat pump operations; wherein determining whether to allow one or more defrost operations comprises: comparing at least one of the determined changes in temperature of the heat exchanger and the change in ambient temperature; and allowing at least one defrost operation if:

the determined time is greater than a predetermined time; and at least one of the changes in temperature of the heat exchanger is a predetermined amount greater than the determined change in ambient temperature.

15. The method of claim 9, further comprising:

determining a time between defrost operations; and restricting one or more defrost operations if the determined time is less than a predetermined time.

16. A heat pump comprising: a heat exchanger, wherein the heat exchanger is exposed to ice accumulation conditions; one or more sensors adapted to monitor one or more changes in temperature of the heat exchanger; a memory storing: one or more of the changes in monitored temperature; and a defrost operation module adapted to: determine one or more changes in temperature of the heat exchanger of the heat pump; and determine whether to allow at least one defrost operation of the heat pump at least partially based on at least one of the determined changes in temperature; and a processor adapted to execute the defrost operation module.

17. The heat pump of claim 16, wherein the defrost operation module is further adapted to: determine a time between defrost operations; and restrict one or more defrost operations if the determined time is less than a predetermined time.

18. The heat pump of claim 16, wherein at least one of the sensors is adapted to monitor ambient temperature proximate the heat exchanger; and wherein the defrost operation module is further adapted such that determining whether to allow at least one defrost operation is at least partially based on at least one of the determined changes in temperature of the heat exchanger or the monitored ambient temperature.

19. The heat pump of claim 16, wherein at least one of the sensors is adapted to monitor ambient temperature proximate the heat exchanger; and wherein the defrost operation module is further adapted such that determining whether to allow at least one defrost operation comprises allowing at least one defrost operation if a change in ambient temperature is greater than approximately 1.2 times one of the determined changes in temperature of the heat exchanger.

20. The heat pump of claim 16, wherein at least one of the sensors is adapted to monitor one or more heat pump operation properties; and wherein the defrost operation module is further adapted such that determining whether to allow at least one defrost operation is at least partially based on at least one of the determined changes in temperature of the heat exchanger and at least one of the monitored heat pump operation properties.

* * * * *